US006237808B1

(12) United States Patent
Straub et al.

(10) Patent No.: US 6,237,808 B1
(45) Date of Patent: May 29, 2001

(54) METHOD AND DEVICE FOR EMPTYING A DRUM FILLED WITH SOLIDS

(75) Inventors: Peter C. Straub, Stallikon (CH); Willi Heinrich, East Liverpool, OH (US)

(73) Assignee: Von Roll Umwelttechnik AG, Zurich (CH)

( * ) Notice: Subject to any disclaimer, the term of this patent is extended or adjusted under 35 U.S.C. 154(b) by 0 days.

(21) Appl. No.: 09/431,399

(22) Filed: Nov. 1, 1999

(30) Foreign Application Priority Data

Oct. 30, 1998 (CH) ..... 2199/98

(51) Int. Cl.[7] ..... B65B 69/00

(52) U.S. Cl. ..... 222/88; 222/1; 222/81; 222/87; 414/412; 414/417; 141/330; 100/98 R; 100/902

(58) Field of Search ..... 222/1, 81–83.5, 222/87, 88; 141/329, 330; 414/412, 417; 100/98 R, 102, 902

(56) References Cited

U.S. PATENT DOCUMENTS 4,126,160 * 11/1978 Gurtler ..... 141/330
4,396,340 * 8/1983 Clinton ..... 414/412
4,735,368 * 4/1988 Janko et al. ..... 414/412
5,109,763 * 5/1992 Morris et al. ..... 100/98 R

FOREIGN PATENT DOCUMENTS 2 082 540 3/1982 (GB) .
2 099 928 12/1982 (GB) .

* cited by examiner

*Primary Examiner*—J. Casimer Jacyna
(74) *Attorney, Agent, or Firm*—Cohen, Pontani, Lieberman & Pavane

(57) ABSTRACT

In a method for emptying drums which are filled with solids and the lids of which have already been removed, the drum base is separated from the drum and the solids are forced out of the drum with the aid of a pressing body.

An apparatus for emptying drums filled with solids has a cutting ring for removing the drum base. For the purpose of emptying the drum freed from the drum base and the rum lid, the apparatus has a pressing body which is in the form of a ram and, driven by hydraulic cylinders, can be displaced along the longitudinal axis in the direction of the cutting ring. A stop supports the drum against force acting in the direction of displacement while the solids are being forced out of the drum by the ram.

30 Claims, 5 Drawing Sheets

9
40
9
16/36
38
r5
A
18
32
32
60
10
r2
24
58
22
30
28
58
62
12
22
a
42
c
14
r1
46
r4
r3
21
50
52
34
30
26
28
48
17
9
9

Fig. 3b Sect.B-B 9
40
90
86
82
16/36
18
21
12
48
78
76
94
80
32
38
14
c
50
58
72
74
98
10"
10"
9
16/36
40
86
18
70
96
90
80
82
38
92
A
b
14
50
21
12
48

10"
9
80
16/36
40
82
86
38
21
12
48
14
50
A
b
90
100
32'
98

METHOD AND DEVICE FOR EMPTYING A DRUM FILLED WITH SOLIDS

BACKGROUND OF THE INVENTION

1. Field of the Invention

The invention relates to a method for emptying drums filled with solids and to an apparatus for emptying drums filled with solids.

2. Discussion of the Prior Art

To fully exploit the holding capacity of drums, drums are nowadays often filled with solids with the aid of a so-called "drum compactor", i.e. the solids are highly compressed as they are introduced into the drums and are stored in compacted form in the drum. The compaction gives rise to a compact mass of solids in which in some cases the individual parts and particles adhere firmly to one another. A drum packed in this way and filled with a firmly cohering mass of solids can often no longer be emptied simply with the aid of gravity by turning the drum over with the lid end downwards after removal of the drum lid. Highly viscous materials, which of course behave in a similar way to firmly cohering solids, are also often virtually impossible to remove from their drums. Simply turning the drums over and repeatedly jerking the inverted drum upwards are often unsuccessful both in the case of drums containing highly viscous materials and those containing compacted solids. Attempts to empty the drum with the aid of an auger are likewise often unsuccessful. Burning the drums with their contents in the case of waste drums is generally not justifiable from an ecological point of view and is moreover uneconomical since the drums may damage the lining of the incineration furnaces. The downtimes for repairing an incineration plant and the costs of repair themselves make it uneconomical to incinerate the drums, especially in the case of incineration furnaces for special waste.

SUMMARY OF THE INVENTION

It is therefore the object of the present invention to provide a method and an apparatus for emptying drums filled with solids in a simple and effective manner.

In the method according to the invention, a drum which has been freed from its lid is separated from its drum base and the solids which it contains, which may also include highly viscous materials, are forced out of the drum with the aid of a pressing body which penetrates into the drum. The advantage of this method resides in the fact that the drum can always be emptied, irrespective of the composition and consistency (compaction) of the solids. Loose solids fall more or less spontaneously out of the drum when they are pushed out of the drum by a pressing body, while highly compacted solids are driven out of the drum in the form of a plug by the pressing body.

It is advantageous if the drum base is cut off the drum by means of a cutting ring on which the drum is placed approximately vertical on its drum base. This ensures that the cutting forces which occur are distributed uniformly over the approximately circular cutting line defined by the cutting ring.

A particular advantage is obtained if a cutting force acting on the longitudinal axis of the drum is applied since this ensures that only forces parallel to the drum wall act on the drum. The cutting ring then acts like a punching tool.

If the pressing body penetrates into the drum at the lid end, the lid having previously been removed, the separation of the drum base from the drum and the emptying of the drum can be performed in a single working step. Another advantage of this procedure is that the cutting force is transmitted to the cutting ring via the solids inside the drum and via the drum base, and deformation of the drum can therefore be largely avoided.

An apparatus according to the invention makes it possible to use a cutting ring to separate a drum base from the drum, giving access to solids in the drum at the lid end and at the base end. This enables the solids to be forced out of the drum, with the aid of a pressing body provided in the apparatus and of a stop. Arranging the cutting ring, the stop and the pressing body on a longitudinal axis which corresponds to the longitudinal axis of the drum to be positioned enables the drum to be left in the same position in the apparatus for all the working steps. While the solids are forced out of the drum, the drum is supported by a drum wall edge on the stop. This ensures that the only forces acting on the drum wall as the solids are forced out are axial and this is particularly advantageous.

It is advantageous if the pressing body is arranged in such a way relative to the cutting ring and the stop that it penetrates into the drum at the lid end and the drum is emptied at the bottom. This allows the separated drum base to be forced out of the drum and disposed of together with the solids without the risk that the drum base will tilt in the drum.

In a particularly advantageous embodiment, the cutting ring is dimensioned in such a way that it cuts within the drum wall. This makes it easier to position the drum on the cutting ring since the projecting drum wall generally surrounds the drum base in the form of a bead. It is also advantageous if the cutter of the cutting ring is designed with teeth, ideally with triangular teeth, since this means that the cutting force initially acts only pointwise at the tips of the teeth, facilitating penetration of the cutter into the drum base.

It is particularly advantageous to configure the stop in such a way that the drum wall edge rests over its entire circumference on the stop since this ensures uniform distribution of the forces acting on the drum wall over the entire drum wall. A grid or a plate or something similar having an aperture concentric with the cutting ring can be used as the stop, for example. The radius of this aperture preferably corresponds to at least an external radius of the pressing body since this allows the drum to be emptied without obstruction. Moreover, it allows the pressing body to be moved through such an aperture in the stop without problems.

In a particularly advantageous embodiment, the cutting ring is arranged in a fixed manner and the pressing body can be displaced along the longitudinal axis in the direction of the cutting ring in the form of a ram. Such an embodiment allows the drum base to be cut off and the solids to be forced out of the drum in a single working step.

In such an embodiment, it is advantageous if the cutting ring is fixed in a holding device which simultaneously forms the stop.

In addition to the cutting ring secured in or on the holding device, it is advantageous to provide an additional stop, which is arranged between the drum to be positioned and the holding device and can be displaced along the longitudinal axis. Such a stop has an aperture with a radius that is greater than the external radius at the cutting ring and can be displaced between a holding position and a stop position. In the holding position, the stop is positioned ahead of the cutting ring in the direction of the drum while, in the stop position, the cutter of the cutting ring is positioned ahead of the stop in the direction of the drum. This allows the stop to be used both for positioning the drum on the cutting ring and, after emptying, to be used again to release the drum from the cutting ring.

If the stop can be displaced beyond the holding position in the direction of the pressing body, it can be used to help compress the drum wall against a stop plate. In this arrangement, the stop plate is situated on the pressing-body side, opposite the stop, and at least one times the drum height from the latter. To stabilize the drum wall during compression, it is particularly advantageous to leave the pressing body within the drum wall until the pressing operation is complete.

A positioning device which positions the drum in the apparatus and preferably also removes the emptied drum from the apparatus allows the emptying of drums to be automated.

If the apparatus is positioned above a container, the solids can be collected in the container. Positioning the apparatus above a container in this way is recommended, for example, for emptying waste drums, the apparatus being arranged, for example, over a pit or a waste bunker.

If the entire apparatus is arranged in such a way that the drum is upright during emptying and the pressing body performs its working stroke from the top downwards, the action of gravity can additionally be used to empty the drum. In this case, moreover, there is no need for any additional holding devices for the drum since the drum is held on the cutting ring and the stop by gravity.

The various features of novelty which characterize the invention are pointed out with particularity in the claims annexed to and forming a part of the disclosure. For a better understanding of the inanition, its operating advantages, and specific objects attained by its use, reference should be had to the drawing and descriptive matter in which there are illustrated and described preferred embodiments of the invention.

BRIEF DESCRIPTION OF THE DRAWINGS

The invention will be explained by way of example below with reference to the Figures, which are purely schematic and of which:

FIG. 3*b* shows the apparatus from FIG. 3*a* in section along the line B—B.

DETAILED DESCRIPTION OF THE PREFERRED EMBODIMENTS

Figure 1:
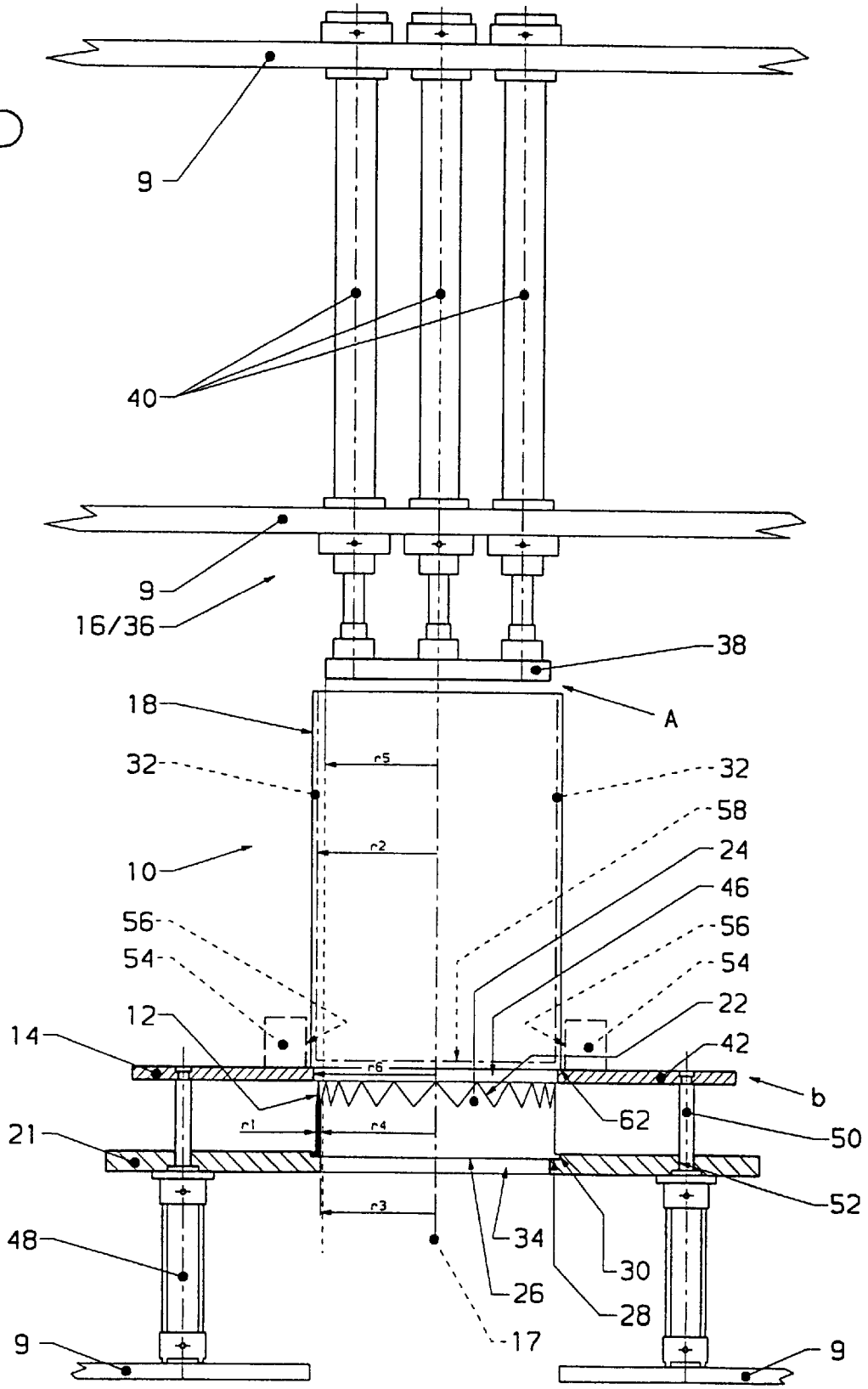
FIG. 1 shows an apparatus for emptying drums filled with solids, with a drum positioned in the apparatus before being positioned on a cutting ring of the apparatus.
Figure 2:
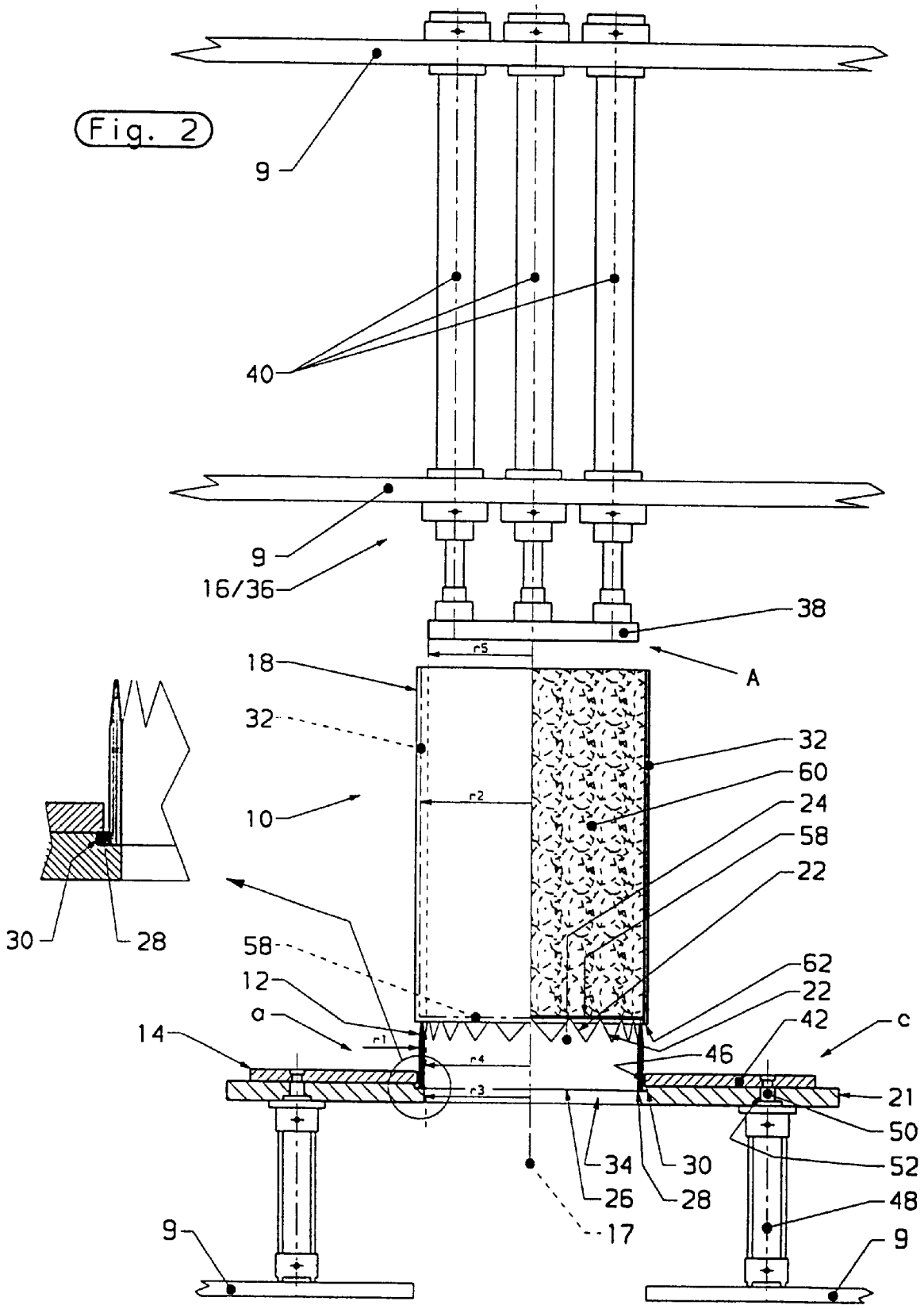
FIG. 2 shows the apparatus and the drum from FIG. 1 with the drum positioned on the cutting ring.

FIGS. 1 and 2 show an apparatus 10 according to the invention with a cutting ring 12, a stop 14 and a pressing body 16 accommodated in such a way on a longitudinal axis 17 in a supporting frame 9 that the drum 18 to be positioned can be introduced vertically into the apparatus 10 with its drum base 58 at the bottom, as illustrated in FIGS. 1 and 2. The cutting ring 12 is then approximately horizontal underneath the drum 18.

The cutting ring 12 is secured in a holding device 21 with the aid of a clamping ring 28 for example. The cutter 22 of the cutting ring 12 projects beyond the holding device 21 towards the drum 18. In the embodiment shown in FIGS. 1 and 2, the opposite edge 26 of the cutting ring 12 from the cutter 22 is supported in a cutout 30. A hole 34 in the holding device 21, said hole being situated directly below the cutout 30 and arranged concentrically with respect to the cutting ring 12, has a hole radius r3 equal to the internal radius r3 of the cutting ring 12.

As can be seen clearly in FIG. 2, the cutting ring 12 is dimensioned in such a way that the cutter 22 cuts within the drum wall 32. The external radius rl of the cutting ring 12 is thus smaller than the internal radius r2 of the drum. The cutter 22 of the cutting ring 12 is in the form of triangular teeth 24.

The pressing body 16 is in the form of a hydraulic ram 36, which has a ram plate 38. The ram plate 38 has a plate radius r5 and the following applies: r5<r2<r3, r4. The ram 36 can be displaced from its rest position A along the longitudinal axis 17 by means of three hydraulic cylinder/piston units 40, it being possible to move the ram plate 38 through the cutting ring 12 and the hole 34 in the holding device 21 during one working stroke. This makes it possible to prevent the cutting ring 12 and the hole 34 from becoming blocked.

In the example illustrated in FIGS. 1 and 2, the stop 14 is designed in such a way that it can be used both to position the drum 18 on the cutting ring 12 and to release the emptied drum 18 from the cutting ring 12. For this purpose, the stop 14 is in the form of a plate 42 with an aperture 46, the aperture radius r6 of which is greater than the external radius rl of the cutting ring 12. The stop 14, designed as a plate 42, is positioned in front of the holding device 21 relative to the drum 18 and arranged in such a way that the aperture 46 and the cutting ring 12 are concentric. The plate 42 can be displaced along the longitudinal axis 17 by means of hydraulic cylinders 48, more specifically between a stop position a, in which the stop 14 rests on the holding device 21 of the cutting ring 14 (c.f. FIG. 2), and a holding position b, in which the stop 14 is spaced apart from the holding device 21 in such a way that it is positioned ahead of the cutter 22 of the cutting ring 12 (c.f. FIG. 1)

In the example shown in FIGS. 1 and 2, the hydraulic cylinders 48 are firmly connected to the holding device 21, underneath the latter. The associated pistons 50 are passed through access openings 52 in the holding device 21 and firmly connected to the plate 42. To allow easy positioning on the plate 42 and prevent sideways slipping of the drum 18 during the movement of the plate 42, a hollow cylinder, for example, or some other retaining device 54 with a location opening 56 concentric with the hole 46 can be arranged on the plate 42, as illustrated by broken lines in FIG. 1. The location opening 56 is dimensioned in such a way that the drum 18 fits in with a clearance.

Figure 3A:
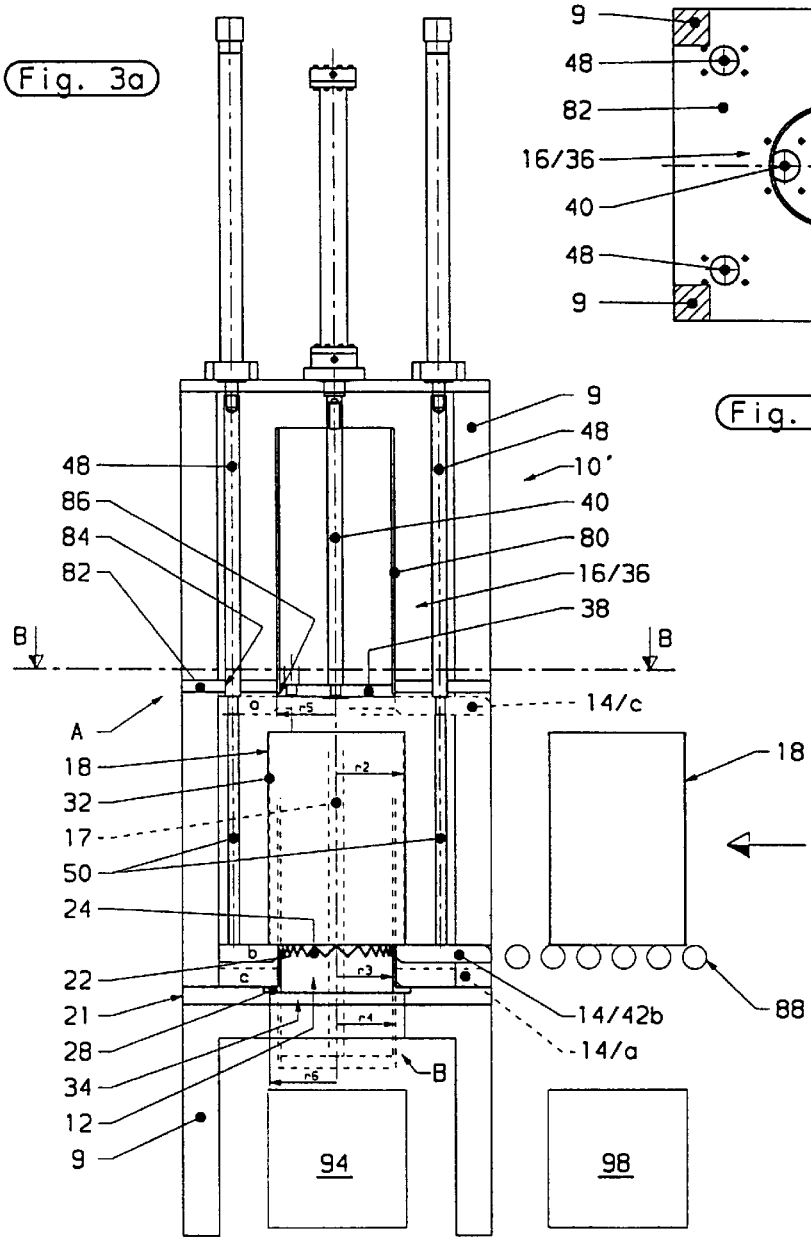
FIG. 3*a* is a side view of another preferred embodiment of the apparatus with a drum positioned in the apparatus, it being possible to move the stop towards the pressing body against a stop plate, thereby allowing a drum wall to be compressed in the direction of the longitudinal axis of the drum.
Figure 3A:
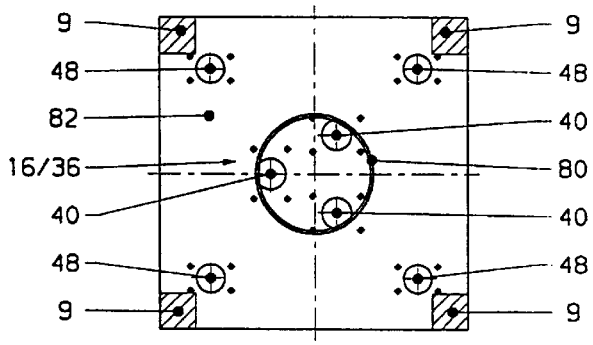

The apparatus 10' shown in FIGS. 3*a* and 3*b* is of essentially identical construction to the apparatus 10 illustrated in FIGS. 1 and 2. Identical elements are therefore denoted by the same reference symbols. In contrast to apparatus 10, the pressing body 16 in the apparatus 10' shown in FIGS. 3*a*, 3*b* has not only a ram plate 38 but also a jacket cylinder 80 surrounding the hydraulic cylinders 40 and connected to the ram plate 38. The jacket cylinder 80 prevents solids 60 which pass though a lateral gap between the drum wall 32 and the ram plate 38 from reaching the opposite side of the ram plate 38 from the drum 18 when the pressing body 16 penetrates into the drum 18 and possibly soiling the ram plate 38 and the hydraulics 40. For this purpose, the ram plate 38 is either an accurate fit in the jacket cylinder 80 or the jacket cylinder 80 has the same external radius r5 as the ram plate 38 and is placed against the ram plate 38 on the side away from the drum. It is very important, particularly in the case of drums filled with special waste, to prevent contamination of the opposite side of the ram plate from the drum with the contents of the drum.

Another difference with respect to the apparatus 10 illustrated in FIGS. 1 and 2 is that a stop plate 82 is arranged on the same side as the pressing body 16, opposite the cutting ring 12. The stop 14 can be displaced hydraulically along the longitudinal axis 17 beyond its holding position b and into a pressing position c against this stop plate 82, thereby allowing the drum wall 32 to be compressed once the drum 18 has been emptied. In this example, the hydraulic cylinders 48 for the pistons 50 which move the stop 14 are arranged on the same side as the pressing body 16, the pistons being passed through openings 84 in the stop plate 82. concentrically with the cutting ring 12 and the pressing body 16, the stop plate 82 has another opening 86 to allow the pressing body 16 to be passed through.

As illustrated in FIGS. 4*a* to 4*e*, it is also possible to provide the stop plate 82 with a hydraulic cylinder/piston unit 90 on the side remote from the drum and thus make the stop plate 82 movable in the direction of the stop 14. It is also possible for the stop plate 82 and stop 14 to be designed in such a way that they can be moved towards one another.

For the sake of simplicity, the method for emptying a drum 18 filled with solids 60, which is also taken to include highly viscous substances, will be described with reference to the apparatuses illustrated in the figures.

Figures 4A, 4B:
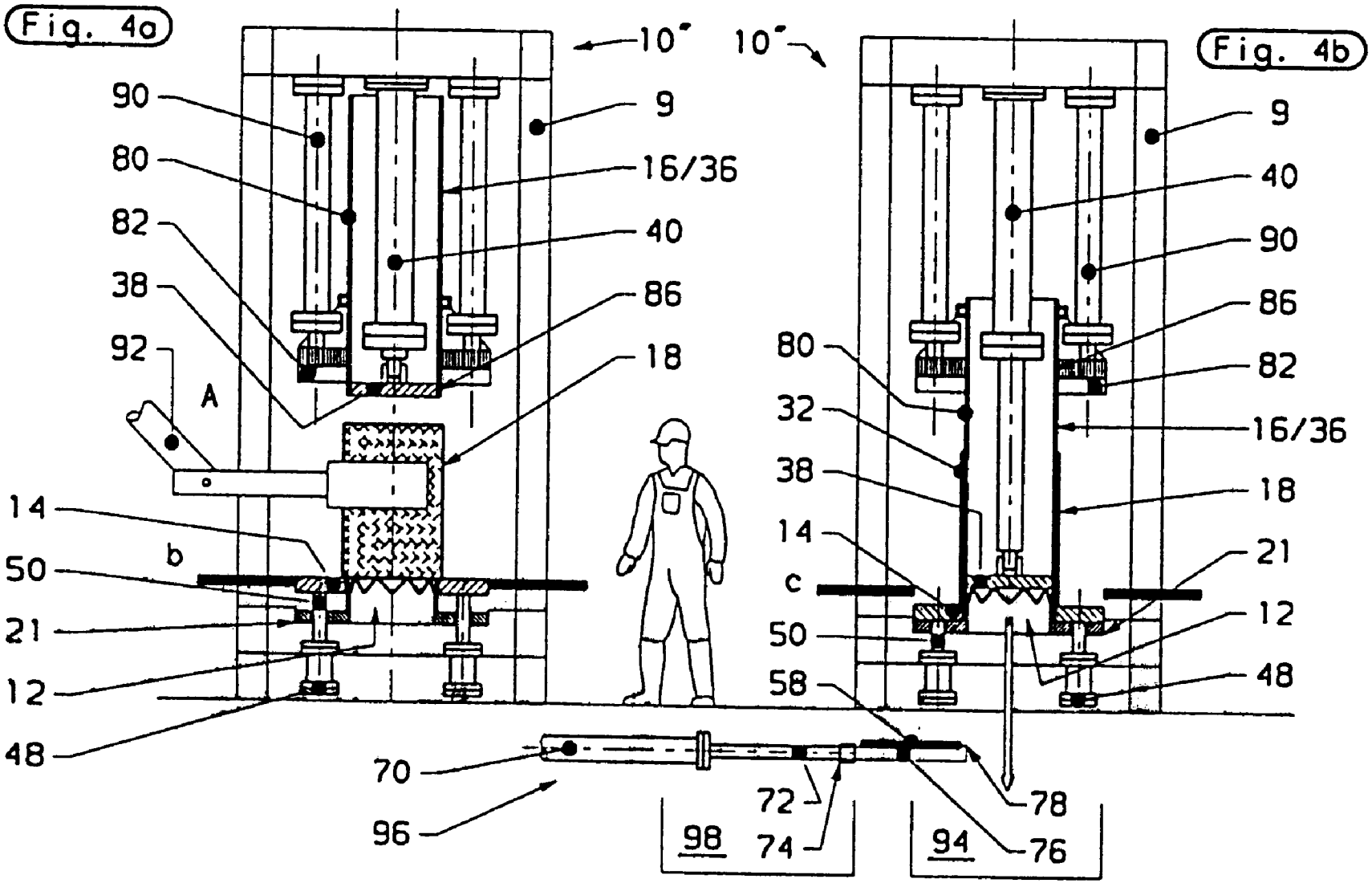
FIGS. 4*a* to 4*e* show a longitudinal section through a third preferred embodiment of the apparatus with a drum positioned in the apparatus at various stages of the process.

A drum 18, the lid of which has already been removed, is transported into position by means, for example of a roller drive 88 of the type illustrated in FIG. 3*a* and is set up on the stop 14, which is in the holding position b, by means of a positioning device 92, for example, of a driven hollow cylinder of adjustable diameter or a corresponding robotic grab of the type illustrated in FIG. 4*a*. Here, the drum stands on the plate 42 of the stop 14 concentrically with the aperture 46 in the stop 14, with its drum base 58 facing downwards. The stop 14 is now displaced into the stop position c, the drum 18 coming to rest by its base 58 on the cutting ring 12, as shown in FIGS. 2 and 4*b*. The ram 36 is now displaced against the cutting ring 12 along the longitudinal axis 17, as shown in FIG. 4*b*. The ram 16 penetrates into the drum 18 at the lid end and its ram plate 38 initially compresses the solids 60 in the drum 18 against the drum base 58. When the solids 60 cannot be compressed further, the pressure acting in a uniformly distributed manner on the solids 60 via the ram plate 38 is transmitted fully to the drum base 58 and to the cutting ring 12. The pressure acting in the direction of the cutting ring, parallel to the drum wall, acts as cutting force and presses the drum base into the teeth 24 of the cutting ring 12. Finally, the drum base 58 is separated from the drum 18 as in a punching process.

The drum base 58 can now be collected in a collecting container 94 underneath the cutting ring 12 together with the solids 60 from the drum 18. However, it is also possible for the drum base 58 to be separated from the contents beforehand by means of a corresponding transport apparatus 96 and transported into a separate container 98 for the drum material. FIG. 4*b* shows a transport apparatus 96 with a hydraulic cylinder 70 and an associated piston 72 as an example. A dish-type element 76 with a flange 78 is connected by a joint 74 to the piston 72 at the front end of the piston 72. While the drum base 58 is being separated from the drum 18, the dish-type element 76 is underneath the cutting ring 12 to catch the drum base 58 if it falls downwards after being cut off. The drum base 58 is transported hydraulically on the dish-type element 76 until it is above container 98. By means of the joint 74, the dish-type element 76 is tilted through at least 90° above the container 98 and the drum base 58 is dropped from the dish-type element 76 into the container.

The working stroke of the pressing body 16 continues and the drum 18 is pressed down together with its contents above the cutting ring 12 until the edge 62 of its wall strikes the stop 14 and is held by the latter against the pressure of the pressing body 16. The solids 60 are pushed further downwards by the ram 36 and forced out of the drum 18 at the bottom and then through the hole 34 in the holding device 21 into the collecting container 94. If the drum base 58 sticks to the solids 60 from the drum 18, it is pushed out of the drum 18 together with the solids 60 and can be stripped laterally off the solids 60 by means of the flange 78 when it reaches the dish-type element 76.

The separation of the drum base 58 from the drum 18 and the emptying of the drum 18 are thus performed in a single working step. In this process, relatively loose solids 60 are first of all compacted by the ram 36 before the drum base 58 is separated from the drum 18 and fall in compacted form out of the drum 18 or fall out loose if compaction has not caused the solid particles in the drum 18 to stick together. Solids 60 stored in a highly compacted form in the drum 18, on the other hand, cannot generally be compacted further and are forced out of the drum like a plug.

After emptying, the stop 14 is displaced back into the holding position, the drum 18, which rests by the edge 62 of its wall on the stop 14, being pushed upwards beyond the cutting ring 12 and released from the cutting ring 12.

In the embodiment of the apparatus 10 illustrated in FIGS. 1 and 2, the empty drum 18 is now removed from the stop 14 by means, for example, of a positioning device 92, as shown in FIG. 4*a*, or a removal device and is disposed of in a collecting container 96, for example.

Figures 4C, 4D, 4E:
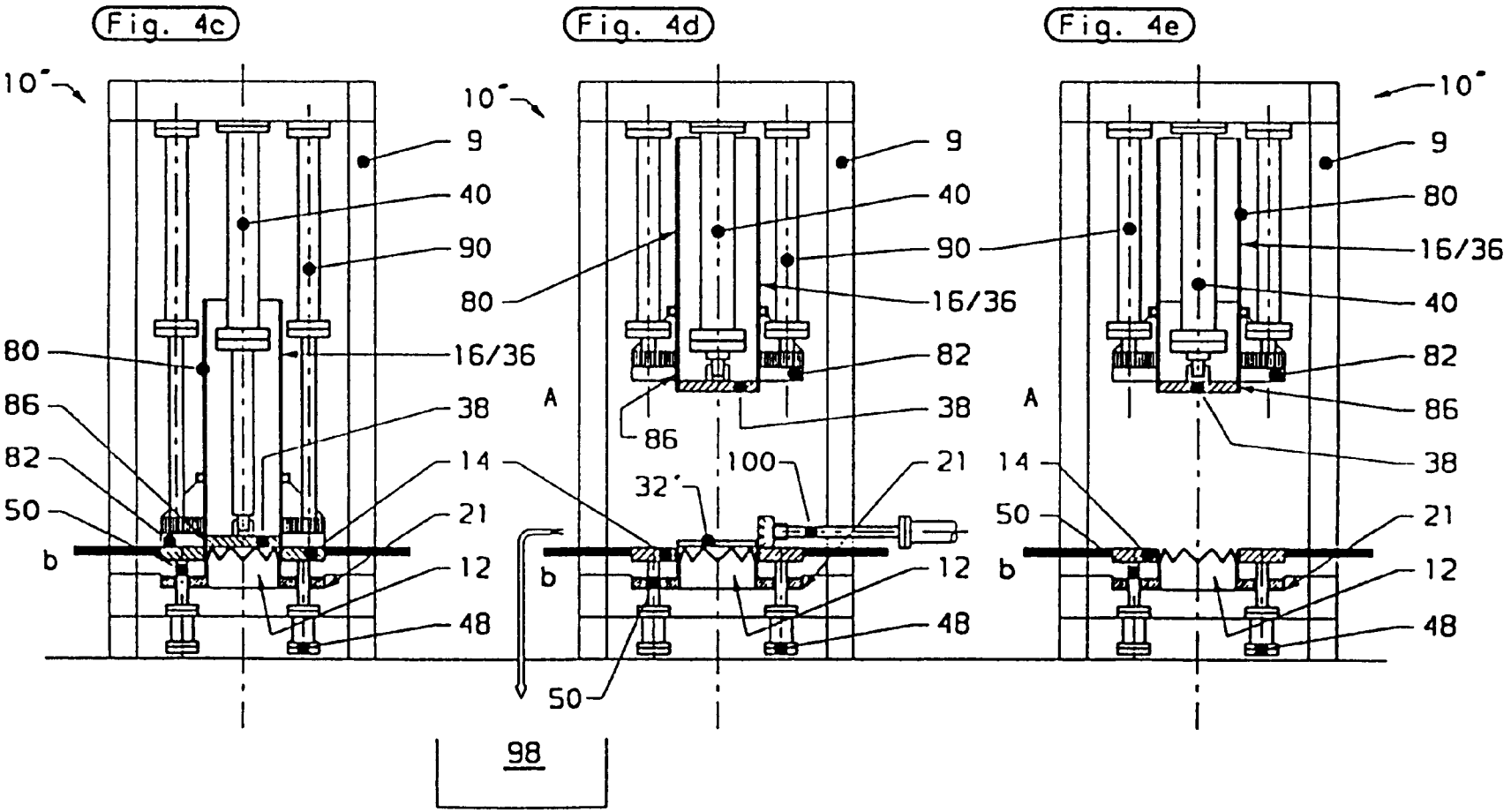

In the apparatuses 10', 10" illustrated in FIGS. 3*a*, 3*b* and 4*a* to 4*e*, the cylindrical drum wall 38 is then compressed in the direction of the longitudinal axis 17 following the emptying of the drum 18. For this purpose, either the stop 14 can be moved hydraulically up to the stop board 82, as in FIG. 3*a*, or the stop board 82 can be moved hydraulically towards the stop 14, as shown in FIGS. 4*a* to 4*e*. For the purpose of stabilization, the jacket cylinder 88 of the pressing body 16 remains in the center of the drum wall 58 as the latter is compressed, as can be seen from FIG. 4*c*. Finally, the compressed drum wall 32' can be removed from the apparatus 10, 10" by means of a corresponding device 100, as illustrated in FIG. 4*d*, and can, for example, likewise be transported into the container 98 for the drum material.

Finally, a new drum 18 filled with solids 60 can be positioned and the process can begin again.

Instead of a cutting force applied solely in the form of a pressure acting parallel to the drum wall, it is also conceivable for the cutting ring to be rotated rapidly in addition, giving rise to sheer forces, with the result that the separation of the drum base 58 from the drum 18 resembles less a punching operation than a cutting operation.

The apparatus 10, 10', 10" can of course also be arranged with its longitudinal axis 17 horizontal or sloping downwards. An upward slope or even a mirror-inverted arrangement is also conceivable but, with these embodiments, a special holding device must be provided to hold the drum 18 since it is not held on the cutter 22 of the cutting ring 12 by gravity.

Instead of the displaceable stop 14, it is also possible, for example, for the holding device 21 of the cutting ring 12 to be provided as stop 14. The stop 14 and the stop plate 82 can also be implemented as a grid instead of as a plate or in the form of bracing formed, for example, by beams.

Displacement of the cutting ring 12 and of the stop 14 together with the drum 18 against a pressing body 16 is also conceivable and would lead to the same goal, as would moving elements 12, 14 and 16/36 towards one another.

The pressing body 16/36 can also be driven into the drum 18 at the bottom and the solids 60 can be forced out at the lid end. In that case, however, the drum base 58 may have to be removed in a separate step or be pushed through the drum 18 with the solids 60.

Even holding the drum 18 during the working stroke of the pressing body by some other means than the stop 14 is conceivable provided the forces for holding the drum are not greater than the resistance to deformation of the drum walls 32. However, this should seldom be the case with drums containing compressed materials and made from conventional drum materials.

The invention is not limited by the embodiments described above which are presented as examples only but can be modified in various ways within the scope of protection defined by the appended patent claims.

We claim:

1. A method for emptying a drum which has a base and is filled with solids and has been freed from its drum lid, comprising the steps of:

separating the drum base from the drum; and forcing the solids out of the drum with a pressing body that penetrates into the drum.

2. A method as defined in claim 1, wherein the separating step includes separating the drum base from the drum with a cutting ring by positioning the drum approximately vertically with the drum base on the cutting ring.

3. A method as defined in claim 2, wherein the cutting ring is horizontally arranged beneath the drum.

4. A method as defined in claim 2, further including applying a pressure, acting in a direction of a longitudinal axis of the drum, to the cutting ring as a cutting force for separating the drum base from the drum.

5. A method as defined in claim 4, wherein the step of applying pressure includes applying the cutting force by means of the pressing body via the solids in the drum and the drum base.

6. A method as defined in claim 1, wherein the pressing body penetrates into the drum at the lid end and the solids are forced out of the drum at the base end, and the separation of the drum base from the drum and the forcing out of the solids taking place in one working step.

7. A method as defined in claim 6, further including supporting the drum by a drum wall edge against a stop while the solids are being forced out.

8. A method as defined in claim 1, further including the step of compressing a drum wall in a direction of a longitudinal axis of the drum.

9. A method as defined in claim 8, wherein the pressing body remains in a center of the drum wall to perform a stabilizing function during the compressing step.

10. An apparatus for emptying a drum which is filled with solid and has been freed from its drum lid, comprising:

a cutting ring for separating a base from the drum;

a pressing body for forcing the solids out of the drum by penetrating into the drum; and a stop for supporting a drum wall edge of the drum while the solids are being forced out of the drum, the cutting ring, the pressing body and the stop being arranged on a longitudinal axis corresponding to a longitudinal axis of the drum positioned in the apparatus, the stop and the pressing body being arranged so that the drum is placeable between them, at least one of the stop and the pressing body being displaceable along the longitudinal axis.

11. An apparatus as defined in claim 10, wherein the pressing body is arranged relative to the cutting ring and the stop so that it penetrates into the drum at the lid end and forces the solids out of the drum at the base end during performance of a working stroke.

12. An apparatus as defined in claim 10, wherein the cutting ring is dimensioned so that it cuts the drum base within the drum wall.

13. An apparatus as defined in claim 12, wherein the cutting ring includes a toothed cutter.

14. An apparatus as defined in claim 13, wherein the toothed cutter has triangular teeth.

15. An apparatus as defined in claim 10, wherein the stop is designed so that it supports the drum wall edge over its entire circumference, the stop having a circular aperture arranged approximately concentrically with respect to the cutting ring and having a radius that is no larger than an internal radius of the drum.

16. An apparatus as defined in claim 15, wherein the stop is formed as one of a grid and a plate.

17. An apparatus as defined in claim 15, wherein the radius of the circular aperture of the stop is at least as large as a radius of the pressing body.

18. An apparatus as defined in claim 10, wherein the cutting ring is arranged in a fixed manner, the pressing body being a ram displaceable towards the cutting ring so as to have an amplitude of motion corresponding to at least one times the drum height.

19. An apparatus as defined in claim 18, and further comprising a holding device, the cutting ring being fixed in the holding device.

20. An apparatus as defined in claim 19, wherein the holding device is a body with an approximately circular hole, the cutting ring being secured concentrically one of in and above the hole, the holding device forming the stop.

21. An apparatus as defined in claim 20, wherein the holding device is formed as one of a grid a plate.

22. An apparatus as defined in claim 19, wherein the stop is arranged between the drum to be positioned and the holding device of the cutting ring and is displaceable along the longitudinal axis, more specifically between a stop position in which a cutter of the cutting ring projects beyond the stop in the direction of the drum, and a holding position in which the stop is spaced apart from the holding device in such a way that it projects beyond the cuter of the cutting ring in the direction of the drum so as to position the drum on the cutting ring and to release the drum from the cutting ring after emptying the drum.

23. An apparatus as defined in claim 22, wherein the stop rests on the holding device of the cutting ring.

24. An apparatus as defined in claim 22, wherein a stop plate is arranged at a level of a rest position of the pressing body and wherein one of the stop and the stop plate is movable so that a drum wall can be compressed between the stop and the stop plate.

25. An apparatus as defined in claim 18, wherein the ram includes a ram plate.

26. An apparatus as defined in claim 25, wherein the ram plate is connected to a jacket cylinder so that no contents of the drum can reach a side of the ram plate which lies opposite to the drum.

27. An apparatus as defined in claim 18, wherein the ram has a ram radius which is smaller than an internal radius of the cutting ring and the amplitude of motion during a working stroke extends from a rest position of the ram.

28. An apparatus as defined in claim 10, wherein the stop is designed so that it supports the drum wall edge over its entire circumference, the stop having a circular aperture arranged approximately concentrically with respect to the cutting ring and having a radius that is no larger than an internal radius of the drum, the cutting ring being arranged in a fixed manner, the pressing body being a ram displaceable towards the cutting ring so as to have an amplitude of motion corresponding to at least one times the drum height, the holding device being a body with an approximately circular hole, the cutting ring being secured concentrically one of in and above the hole, the holding device forming the stop, the ram having a ram radius which is smaller than an internal radius of the cutting ring and the amplitude of motion during a working stroke extending from a rest position of the ram through the cutting ring and one of the aperture and the hole in the stop.

29. An apparatus as defined in claim 10, and further comprising means for positioning the drum above the cutting ring.

30. An apparatus as defined in claim 10, and further comprising a container arranged below the drum so that the solids forced out of the drum enter the container.

* * * * *